US009690243B2

(12) United States Patent
Hase et al.

(10) Patent No.: US 9,690,243 B2
(45) Date of Patent: Jun. 27, 2017

(54) IMAGE FORMING APPARATUS INCLUDING A FIXING DEVICE THAT INCLUDES A RADIANT HEAT HEATING SOURCE AND A FIXING MEMBER THAT ROTATES BEFORE AN ABNORMALITY SOLVED

(71) Applicants: Takamasa Hase, Shizuoka (JP); Masahiko Satoh, Tokyo (JP); Shinichi Namekata, Kanagawa (JP); Kenji Ishii, Kanagawa (JP); Takeshi Uchitani, Kanagawa (JP); Tadashi Ogawa, Tokyo (JP); Teppei Kawata, Kanagawa (JP); Arinobu Yoshiura, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Masaaki Yoshikawa, Tokyo (JP); Hiroshi Yoshinaga, Chiba (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Akira Suzuki, Tokyo (JP)

(72) Inventors: Takamasa Hase, Shizuoka (JP); Masahiko Satoh, Tokyo (JP); Shinichi Namekata, Kanagawa (JP); Kenji Ishii, Kanagawa (JP); Takeshi Uchitani, Kanagawa (JP); Tadashi Ogawa, Tokyo (JP); Teppei Kawata, Kanagawa (JP); Arinobu Yoshiura, Kanagawa (JP); Kazuya Saito, Kanagawa (JP); Toshihiko Shimokawa, Kanagawa (JP); Shuutaroh Yuasa, Kanagawa (JP); Kensuke Yamaji, Kanagawa (JP); Masaaki Yoshikawa, Tokyo (JP); Hiroshi Yoshinaga, Chiba (JP); Hiromasa Takagi, Tokyo (JP); Naoki Iwaya, Tokyo (JP); Takuya Seshita, Kanagawa (JP); Takahiro Imada, Kanagawa (JP); Hajime Gotoh, Kanagawa (JP); Akira Suzuki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/928,757

(22) Filed: Oct. 30, 2015

(65) Prior Publication Data

US 2016/0054691 A1 Feb. 25, 2016

Related U.S. Application Data

(63) Continuation of application No. 14/475,254, filed on Sep. 2, 2014, now Pat. No. 9,207,596, which is a (Continued)

(30) Foreign Application Priority Data

Feb. 9, 2012 (JP) ..... 2012-026060
Dec. 26, 2012 (JP) ..... 2012-282400

(51) Int. Cl.
*G03G 15/20* (2006.01)
*G03G 15/00* (2006.01)

(52) U.S. Cl.
CPC ..... *G03G 15/2085* (2013.01); *G03G 15/205* (2013.01); *G03G 15/2039* (2013.01); *G03G 15/2078* (2013.01); *G03G 15/55* (2013.01)

(58) Field of Classification Search
CPC ..... G03G 15/55; G03G 15/205; G03G 15/70
See application file for complete search history.

(56) References Cited

U.S. PATENT DOCUMENTS 5,475,194 A * 12/1995 Watanabe ..... G03G 15/2064 219/216
7,509,066 B2 3/2009 Koshida
(Continued)

FOREIGN PATENT DOCUMENTS

JP 590-19979 A 2/1984
JP S59-19979 A 2/1984
(Continued)

OTHER PUBLICATIONS

JP Office Action issued on Sep. 20, 2016 in corresponding JP Application No. 2012-282400.
(Continued)

*Primary Examiner* — G. M. Hyder
(74) *Attorney, Agent, or Firm* — Oblon, McClelland, Maier & Neustadt, L.L.P.

(57) ABSTRACT

An image forming apparatus includes a fixing device. The fixing device includes a rotatable endless fixing member, a nip forming member arranged inside the fixing member, a pressing member in contact with the nip forming member via the fixing member, and a heating source configured to heat the fixing member. When an abnormality occurs in at least one of the fixing device and other devices included in the image forming apparatus, a rotation of the fixing member is stopped prior to stopping a rotation driving of a discharging unit and, after stopping, the fixing member is controlled to rotate.

27 Claims, 10 Drawing Sheets

Related U.S. Application Data continuation of application No. 13/762,919, filed on Feb. 8, 2013, now Pat. No. 8,855,506.

(56) References Cited

U.S. PATENT DOCUMENTS 7,570,895 B2 8/2009 Ando et al.
7,916,318 B2 3/2011 Nakamura et al.
2002/0061215 A1* 5/2002 Kamei ..... G03G 15/234 399/401
2004/0190958 A1* 9/2004 Matsumoto ..... G03G 15/2032 399/329
2006/0029411 A1 2/2006 Ishii et al.
2006/0051116 A1 3/2006 Koshida
2007/0059012 A1 3/2007 Tomine et al.
2007/0212089 A1 9/2007 Seo et al.
2007/0242988 A1 10/2007 Seo et al.
2007/0264038 A1 11/2007 Koshida
2007/0280754 A1 12/2007 Ogawa et al.
2007/0292175 A1 12/2007 Shinshi
2008/0025772 A1 1/2008 Seo et al.
2008/0025773 A1 1/2008 Ito et al.
2008/0124147 A1 5/2008 Uehara et al.
2008/0219721 A1 9/2008 Ito et al.
2008/0226326 A1 9/2008 Seo et al.
2008/0232873 A1 9/2008 Ueno et al.
2009/0123201 A1 5/2009 Ehara et al.
2009/0136243 A1* 5/2009 Tanaka ..... G03G 15/55 399/21
2009/0148205 A1 6/2009 Seo et al.
2009/0202269 A1 8/2009 Tomine et al.
2009/0245865 A1 10/2009 Shinshi et al.
2009/0245897 A1 10/2009 Seo et al.
2009/0297197 A1 12/2009 Hase
2010/0061753 A1 3/2010 Hase
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0232822 A1* 9/2010 Takenaka ..... G03G 15/2053 399/69
2010/0290796 A1* 11/2010 Sato ..... G03G 15/2039 399/33
2010/0290822 A1 11/2010 Hasegawa et al.
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176821 A1 7/2011 Hase
2011/0176822 A1 7/2011 Ishii et al.
2011/0182634 A1 7/2011 Ishigaya et al.
2011/0182638 A1 7/2011 Ishii et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0236084 A1 9/2011 Nishida et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.

(56) References Cited

U.S. PATENT DOCUMENTS

| | | | |
|---|---|---|---|
| 2012/0148303 | A1 | 6/2012 | Yamaguchi et al. |
| 2012/0155935 | A1 | 6/2012 | Yoshikawa et al. |
| 2012/0155936 | A1 | 6/2012 | Yamaguchi et al. |
| 2012/0177388 | A1 | 7/2012 | Imada et al. |
| 2012/0177393 | A1 | 7/2012 | Ikebuchi et al. |
| 2012/0177420 | A1 | 7/2012 | Shimokawa et al. |
| 2012/0177423 | A1 | 7/2012 | Imada et al. |
| 2012/0177424 | A1 | 7/2012 | Saito et al. |
| 2012/0207523 | A1 | 8/2012 | Ueno et al. |
| 2012/0219312 | A1 | 8/2012 | Yuasa et al. |
| 2012/0224878 | A1 | 9/2012 | Ikebuchi et al. |
| 2012/0237273 | A1 | 9/2012 | Yoshinaga et al. |
| 2013/0195477 | A1 | 8/2013 | Seshita et al. |

FOREIGN PATENT DOCUMENTS

| | | | |
|---|---|---|---|
| JP | 03-259173 | | 11/1991 |
| JP | 2000-269686 | A | 10/2000 |
| JP | 2000-289886 | A | 10/2000 |
| JP | 2003-323068 | A | 11/2003 |
| JP | 2006-011147 | A | 1/2006 |
| JP | 2006259221 | A | 9/2006 |
| JP | 2007-079040 | | 3/2007 |
| JP | 2007-334205 | | 12/2007 |
| JP | 2008-129517 | | 6/2008 |
| JP | 2009-265173 | A | 11/2009 |
| JP | 2010-032625 | | 2/2010 |
| JP | 2010-048987 | A | 3/2010 |
| JP | 2010-048987 | A | 4/2010 |
| JP | 2010-217257 | A | 9/2010 |
| JP | 2010-217457 | A | 9/2010 |
| JP | 2011-85758 | A | 4/2011 |
| JP | 4742165 | | 5/2011 |
| JP | 2011-118153 | A | 6/2011 |
| JP | 4875385 | | 12/2011 |

OTHER PUBLICATIONS

Office Action issued Mar. 7, 2017 in Japanese Patent Application No. 2012-282400.

* cited by examiner

FIG.6

| CAUSE OF ABNORMALITY | STATE AT OCCURRENCE OF ABNORMALITY | STOP PROCESS AT OCCURRENCE OF ABNORMALITY | OPERATION AFTER OCCURRENCE OF ABNORMALITY |
|---|---|---|---|
| FIXING DEVICE IS ABNORMAL | DURING SHEET CONVEYANCE | IMMEDIATE STOP | REVERSE ROTATION OF PRESSING ROLLER FOR ONE TURN |
| | DURING WARM-UP / DURING STANDBY | IMMEDIATE STOP | INTERMITTENT ROTATION UNTIL REACHING BELOW 180°C |
| DEVICE OTHER THAN FIXING DEVICE IS ABNORMAL | DURING SHEET CONVEYANCE | STOP AFTER SHEET ON CONVEYANCE IS DISCHARGED | INTERMITTENT ROTATION UNTIL REACHING BELOW 180°C |
| | DURING WARM-UP / DURING STANDBY | IMMEDIATE STOP | INTERMITTENT ROTATION UNTIL REACHING BELOW 180°C |
| PAPER JAM (OCCURRING AT UPSTREAM OF FIXING DEVICE) | DURING SHEET CONVEYANCE | IMMEDIATE STOP | REVERSE ROTATION OF PRESSING ROLLER FOR ONE TURN |
| PAPER JAM (OCCURRING AT DOWNSTREAM OF FIXING DEVICE) | DURING SHEET CONVEYANCE | STOP AFTER SHEET ON CONVEYANCE IS DISCHARGED | INTERMITTENT ROTATION UNTIL REACHING BELOW 180°C |
| SHORTAGE OF TONER | DURING SHEET CONVEYANCE | STOP AFTER SHEET ON CONVEYANCE IS DISCHARGED | INTERMITTENT ROTATION UNTIL REACHING BELOW 180°C |
| FULLY FILLED WASTE TONER BOTTLE | DURING SHEET CONVEYANCE | STOP AFTER SHEET ON CONVEYANCE IS DISCHARGED | INTERMITTENT ROTATION UNTIL REACHING BELOW 180°C |
| END OF LIFE OF FIXING DEVICE | DURING SHEET CONVEYANCE | STOP AFTER SHEET ON CONVEYANCE IS DISCHARGED | INTERMITTENT ROTATION UNTIL REACHING BELOW 180°C |
| | DURING WARM-UP / DURING STANDBY | IMMEDIATE STOP | INTERMITTENT ROTATION UNTIL REACHING BELOW 180°C |

IMAGE FORMING APPARATUS INCLUDING A FIXING DEVICE THAT INCLUDES A RADIANT HEAT HEATING SOURCE AND A FIXING MEMBER THAT ROTATES BEFORE AN ABNORMALITY SOLVED

CROSS-REFERENCE TO RELATED APPLICATIONS

The present application is a continuation of U.S. patent application Ser. No. 14/475,254, filed on Sep. 2, 2014, which is a continuation of U.S. patent application Ser. No. 13/762,919, filed on Feb. 8, 2013, and claims priority to Japanese Patent Application No. 2012-026060 filed in Japan on Feb. 9, 2012 and Japanese Patent Application No. 2012-282400 filed in Japan on Dec. 26, 2012. The entire contents of each of the above applications are incorporated by reference herein.

BACKGROUND OF THE INVENTION

1. Field of the Invention

The present invention relates to an image forming apparatus such as a copying machine, a printer, a facsimile, or an MFP having functions of at least two of them.

2. Description of the Related Art

Conventionally, the image forming apparatus in the above form that utilizes the electrophotography has been widely known. Its image forming process includes forming an electrostatic latent image on the surface of the photosensitive drum that is an image carrier, developing the electrostatic latent image on the photosensitive drum to visualize it as an image by the toner that is a developer, and transferring the developed image to a recording medium by the transferring device so as to cause the toner image to be carried. Then, the toner image that has not been fixed on the recording medium is pressed/heated by a fixing device to fix the toner image on the recording medium.

The fixing device comprises a fixing member and a pressing member, and the unfixed image is heated while being held by these fixing member and pressing member, which causes the developer, in particular, the toner included in the unfixed image to be melted and softened and penetrated into the recording medium. Thereby, the toner is fixed to the recording medium.

In this type of fixing devices, when the fixing member is heated up to a predetermined temperature by a heat source, with sufficiently short heating time before the predetermined temperature is obtained, the preheating process under a standby state can be omitted. Consequently, the consumption energy can be significantly reduced. In order to achieve this, as the fixing member, members with low heat capacity, such as a thin roller or a belt comprising a metal base member and an elastic rubber layer, have been widely used. Further, for the heat source, rapid heating has been realized by the use of the IH system having higher heating efficiency, such as a ceramic heater, as well as a halogen heater that heats the fixing member by radiant heat. The fixing devices having these arrangements are disclosed in Japanese Patent Application Laid-open No. 2007-79040, Japanese Patent Application Laid-open No. 2010-32625, Japanese Patent Application Laid-open No. 2007-334205, and Japanese Patent Application Laid-open No. 2008-129517, for example.

A heated area heated by a heating source and a fixing nip are different in position, among these fixing devices, in particular, a device in which a fixing belt is configured to be hanged between a fixing roller and a heating roller, a device in which heating is made by the IH system, and a device that locally heats the fixing member by offsetting the setting position of an embedded halogen heater (partial heating system). Therefore, even if the fixing member has the heated area that is heated to a relatively high temperature, the heat of the fixing member is transferred to the recording medium passing through the fixing nip portion in performing the image fixing operation, and thus the temperature of the fixing member may not be extremely high. However, under a state where the rotation of the fixing member stops such as at the time of completion of the image fixing operation, the remaining heat (residual heat) of the heating source may cause the fixing member to be in an overheating state even if the power supply to the heating source is stopped (when sheets are in a successive conveyance, much larger heat is accumulated inside the fixing device). Alternatively, even when the remaining heat of the heating source does not cause a big problem, the remaining heat of a reflector, a stay, or inner air heated to a high temperature may cause the temperature of the surface of the fixing member to rise after the rotation stops. Further, in a case where the heated area and the fixing nip portion are at a distance, partial heating with a relatively high temperature is made at the heated area so that the necessary heat can be obtained at the time when a part of the belt heated by the heated area moves to the fixing nip portion. Therefore, unless the heat of the part of the belt is dispersed, that part of the belt will be damaged. The fixing member is likely to have such problems, in particular, in the fixing device comprising a fixing member that is further thinned to have lower heat capacity for the reduction of warm-up time or the reduction of consumption energy.

When the image forming apparatus in which the fixing device of the partial heating system as described above is installed suddenly stops due to an occurrence of abnormality, only the portion which faces to the heating source of the fixing member will be heated, causing an uneven temperature distribution in the circumferential direction of the fixing member. Therefore, in the fixing member, a difference in thermal expansion occurs between the portion facing to the heating source and the portion not facing to the heating source. As a result, the portion facing to the heating source is forced to expand in the axial direction, while the portion not facing to the heating source is maintained. Also in the portion facing to the heating source, the portions near both ends in the axial direction of the fixing member lose their heat and thus have a lower temperature than the center portion in the axial direction. Thus, the center portion in the axial direction of the portion facing to the heating source of the fixing member has the thermal expansion to the highest degree. Therefore, the center portion of the portion facing to the heating source of the fixing member is highly forced to expand outward in the axial direction while the portion not facing to the heating source is maintained. Thus, the center portion of the portion facing to the heating source is unable to expand outward, which causes so called kink that is a plastic deformation to warp inward. There has been a problem that the kink occurring in the fixing member then develops to an abnormal image and further causes the fixing member to be broken.

Therefore, there is a need for an image forming apparatus that does not cause the breakage and the like of the fixing member even if an overheating occurs in the fixing member when the fixing device suddenly stops due to the occurrence of the abnormality.

SUMMARY OF THE INVENTION

It is an object of the present invention to at least partially solve the problems in the conventional technology.

According to an embodiment, there is provided an image forming apparatus that includes a fixing device. The fixing device includes a rotatable endless fixing member, a nip forming member arranged inside the fixing member, a pressing member in contact with the nip forming member via the fixing member, and a heating source configured to heat the fixing member. When an abnormality occurs in at least one of the fixing device and other devices included in the image forming apparatus, a rotation of the fixing member is stopped prior to stopping a rotation driving of a discharging unit and, after stopping, the fixing member is controlled to rotate.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a table illustrating types of abnormality occur in the fixing device and processes thereto;

DETAILED DESCRIPTION OF THE PREFERRED EMBODIMENTS

Figure 1:
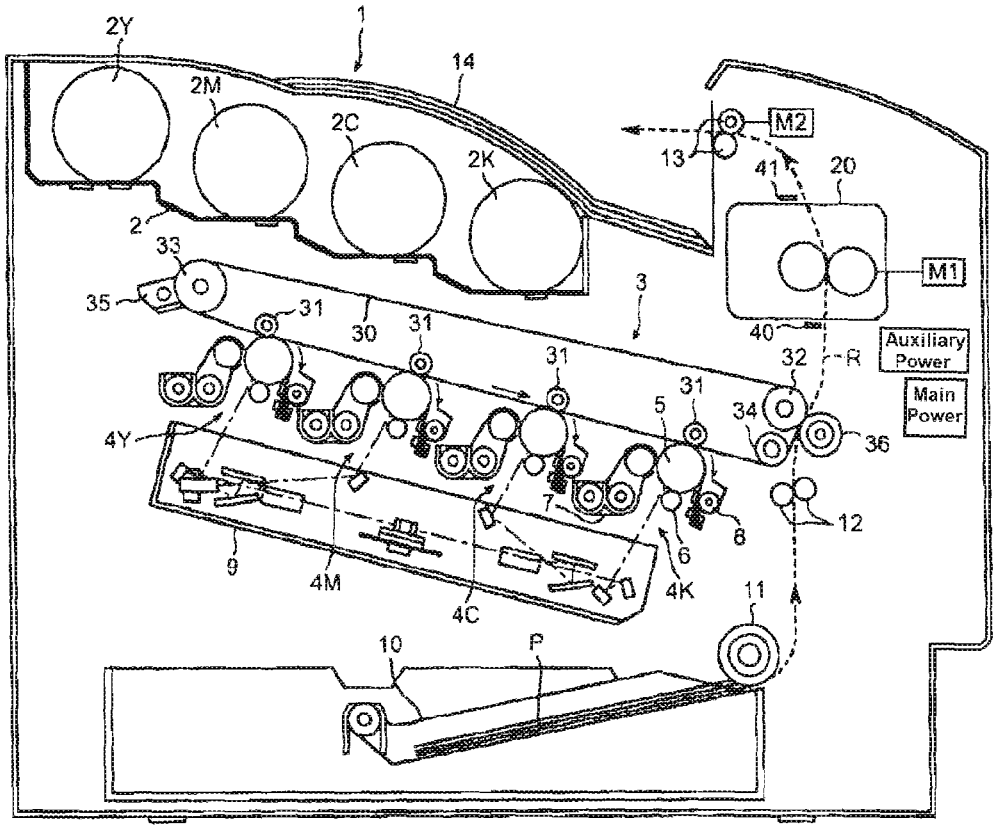
FIG. 1 is an entire view illustrating an image forming apparatus according to an embodiment of the present invention.

Embodiments of the present invention will be described below based on the drawings. It should be noted that, in each drawing for describing the embodiments of the present invention, in order to simplify the description, the elements such as members and components having the same function or shape are provided with the same reference numerals as long as they can be identified.

First, with reference to FIG. 1, description will be given on the entire arrangement and operation of the image forming apparatus according to an embodiment of the present invention.

A printing apparatus 1 is a tandem type color laser printer, and the middle part of the apparatus unit is provided with four image creation units 4Y, 4M, 4C, and 4K. The image creation units 4Y, 4M, 4C, and 4K have the same structure except that they contain respective developers for the different colors of yellow (Y), magenta (M), cyan (C), and black (K) corresponding to the color separation components of a color image.

In details, each of the image creation units 4Y, 4M, 4C, and 4K includes a drum-shaped photosensitive element 5 as a latent image carrier, a charging device 6 for causing the surface of the photosensitive element 5 to be charged, a developing device 7 for supplying toner on the surface of the photosensitive element 5, and a cleaning device 8 for cleaning the surface of the photosensitive element 5. It should be noted that, in FIG. 1, for the image creation unit 4K only, the reference numerals are provided to the photosensitive element 5, the charging device 6, the developing device 7, and the clearing device 8, and the reference numerals are omitted for other image creation units 4Y, 4M, and 4C.

An exposing device 9 for exposing the surface of the photosensitive element 5 is provided under the image creation units 4Y, 4M, 4C, and 4K. The exposing device 9 includes a light source, a polygon mirror, and an f-O lens, a reflection mirror, and irradiates a laser beam onto the surface of each photosensitive element 5 based on the image data.

A transferring device 3 is provided above the image creation units 4Y, 4M, 4C, and 4K. The transferring device 3 includes an intermediate transfer belt 30 as a transfer element, four primary transfer rollers 31 as primary transfer units, a secondary transfer roller 36 as a secondary transfer unit, a secondary transfer backup roller 32, a cleaning backup roller 33, a tension roller 34, and a belt cleaning device 35.

The intermediate transfer belt 30 is an endless belt and is extended in a tensioned state by the secondary transfer backup roller 32, the cleaning backup roller 33, and the tension roller 34. Here, the intermediate transfer belt 30 is adapted to revolve (rotate) in the direction indicated by the arrow in FIG. 1 in response to the rotation driving of the secondary transfer backup roller 32.

The four primary transfer rollers 31 and respective photosensitive elements 5 interpose the intermediate transfer belt 30 to form primary transfer nips. Further, a not-illustrated power supply is connected to each of the primary transfer rollers 31 and a predetermined direct-current voltage (DC) and/or alternating-current voltage (AC) is applied to each of the primary transfer rollers 31.

The secondary transfer roller 36 and the secondary transfer backup roller 32 interpose the intermediate transfer belt 30 to form a secondary transfer nip. Also, similarly to the primary transfer roller 31, a not-illustrated power supply is connected to the secondary transfer roller 36, and a predetermined direct-current voltage (DC) and/or alternating-current voltage (AC) is applied to the secondary transfer roller 36.

The belt cleaning device 35 has a cleaning brush and a cleaning blade provided so as to come into contact with the intermediate transfer belt 30. A not-illustrated waste toner transport hose extended from the belt cleaning device 35 is connected to the inlet of a not-illustrated waste toner container.

The upper part of the printer unit is provided with a bottle accommodation unit 2, and four toner bottles 2Y, 2M, 2C, and 2K each of which contains the toner to be supplied are mounted to the bottle accommodation unit 2 in a removable manner. A not-illustrated supply path is provided between each of the toner bottles 2Y, 2M, 2C, and 2K and each of the developing devices 7, and the toner is supplied via the supply path from each of the toner bottles 2Y, 2M, 2C, and 2K to each of the developing devices 7.

On the other hand, the lower part of the printer unit is provided with a paper feed tray 10 containing a sheet P as a recording medium, and a paper feeding roller 11 for carrying out the sheet P from the paper feed tray 10. Here, the concept of the recording medium may include not only plain paper but also cardboard, a postcard, an envelope, thin paper, coated paper (coat paper, art paper, and the like), tracing paper, and an OHP sheet. Further, although not illustrated, a manual sheet feeding mechanism may be provided.

Inside the printer unit, provided is a conveying path R for carrying the sheet P out of the apparatus from the paper feed tray 10 through the secondary transfer nip. In the upstream side of the secondary transfer roller 36 in the sheet conveying direction in the conveying path R, provided is a pair of timing adjustment rollers 12, called resist rollers, as a conveying unit for conveying the sheet P to the secondary transfer nip.

Further, in the downstream side of the secondary transfer roller 36 in the sheet conveying direction, provided is a fixing device 20 for fixing the unfixed image that has been transferred on the sheet P. An inlet sensor 40 and an exit sensor 41 for sensing the passage of the sheet are provided in the upstream side and in the downstream side, respectively, of the fixing device 20 in the sheet conveying direction.

Furthermore, in the downstream side of the fixing device 20 in the sheet conveying direction of the conveying path R, a pair of ejecting rollers 13 is provided at the discharge section for discharging the sheet out of the apparatus. Further, on the top surface of the printer unit, provided is a discharge tray 14 for stacking the sheets that have been discharged out of the apparatus.

Next, the fundamental operation of the printer according to the present embodiment will be described. Upon the image creation operation being started, each photosensitive element 5 in each of the image creation units 4Y, 4M, 4C, and 4K is rotation-driven clockwise when viewing FIG. 1 by a not-illustrated driving device, and the surface of each photosensitive element 5 is evenly charged in a predetermined polarity by the charging device 6. Laser beams from the exposing device 9 are irradiated onto the surfaces of respective charged photosensitive elements 5, and electrostatic latent images are formed on the respective photosensitive elements 5. At this step, the image information exposed on each of the photosensitive elements 5 is the single-color image information in which a desired full-color image is separated into the color information of yellow, magenta, cyan, and black. As such, the toner is supplied by each developing device 7 to the electrostatic latent image formed on each photosensitive element 5 and thereby the electrostatic latent image appears (is visualized) as a toner image.

Further, upon the image creation operation being started, the secondary transfer backup roller 32 is rotation-driven anticlockwise when viewing FIG. 1 and causes the intermediate transfer belt 30 to rotate in the direction indicated by the arrow in FIG. 1. Then, each primary transfer roller 31 is applied with a voltage which is of the opposite polarity to the charged polarity of the toner and is controlled in a constant voltage or a constant current. Thereby, a transfer electric field is formed in the primary transfer nip between each primary transfer roller 31 and each photosensitive element 5.

Then, in response to the rotation of each photosensitive element 5, when the toner image for each color on the photosensitive element 5 reaches the primary transfer nip, the transfer electric field formed in the primary transfer nip allows the toner image on each photosensitive element 5 to be sequentially overlapped and transferred on the intermediate transfer belt 30. Thus, the full-color toner image is carried on the surface of the intermediate transfer belt 30. Further, the toner on each photosensitive element 5 which has not been transferred to the intermediate transfer belt 30 is removed by the cleaning device 8. Then, the charge is removed from the surface of each photosensitive element 5 by a not-illustrated charge removing device and the surface potential is initialized.

In the lower part of the printing device, the paper feeding roller 11 starts a rotation-drive and the sheet P is carried out from the paper feed tray 10 to the conveying path R. The sheet P carried out to the conveying path R is adjusted in timing by the timing adjustment rollers 12 and is sent to the secondary transfer nip between the secondary transfer roller 36 and the secondary transfer backup roller 32. At this step, the secondary transfer roller 36 is applied with a transfer voltage whose polarity is opposite to the toner charge polarity of the toner image on the intermediate transfer belt 30, and thereby the transfer electric field is formed on the secondary transfer nip.

Then, in response to the revolving of the intermediate transfer belt 30, when the toner image on the intermediate transfer belt 30 reaches the secondary transfer nip, the transfer electric field formed at the secondary transfer nip allows the toner image on the intermediate transfer belt 30 to be transferred on the sheet P all together. Further, the remaining toner on the intermediate transfer belt 30 which was not transferred on the sheet P at that time is removed by the belt cleaning device 35, and the removed toner is conveyed to and collected in the not-illustrated waste toner container.

Then, the sheet P is conveyed to the fixing device 20 and the toner image on the sheet P is fixed to that sheet P by the fixing device 20. The sheet P is then discharged out of the apparatus by the pair of ejecting rollers 13 and stacked in the discharge tray 14.

The description above is directed to the printing operation when forming a full-color image on the sheet. It is of course possible for the present image forming apparatus to use any one of the four image creation units 4Y, 4M, 4C, and 4K to form a single-color image, or use two or three of the image creation units to form a two-color or three-color image.

Figure 2:
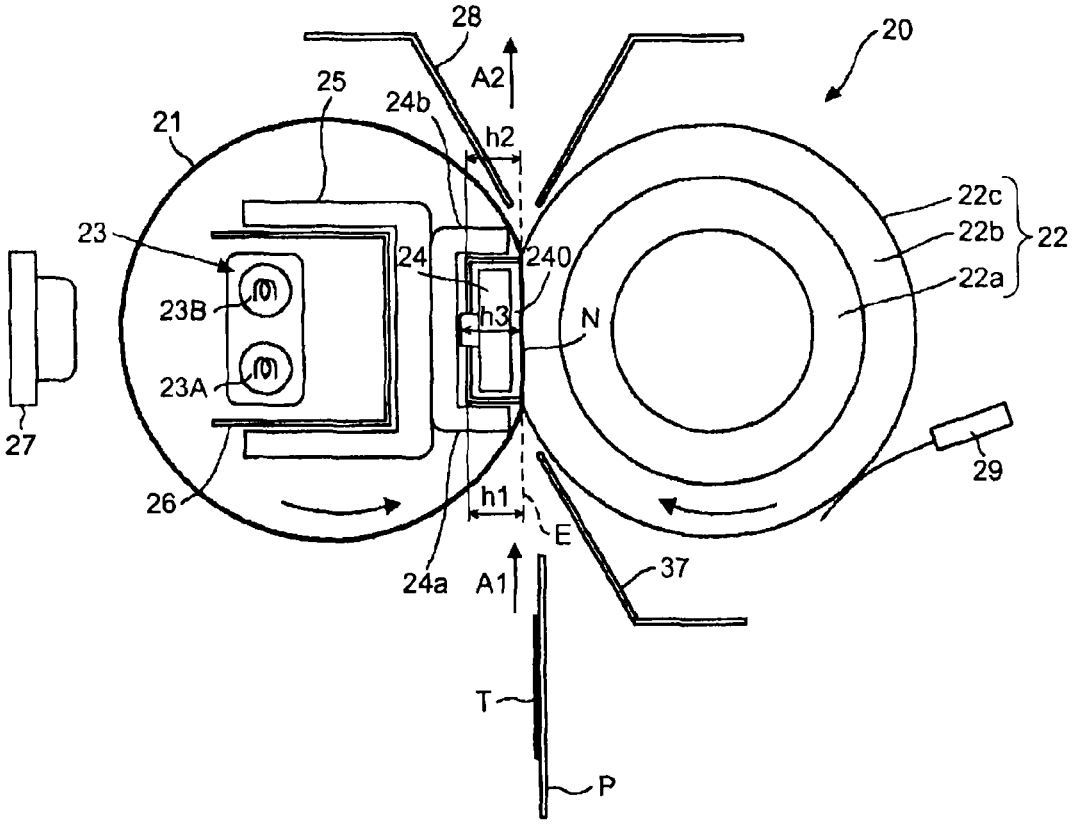
FIG. 2 is a view illustrating a cross section of a fixing device installed in the image forming apparatus of FIG. 1.

Next, the arrangement of the fixing device 20 will be described. As illustrated in FIG. 2, the fixing device 20 has a fixing belt 21 as a rotatable fixing member, a pressing roller 22 as a pressing member facing to the fixing belt 21, and a halogen heater 23 as a heating source for heating the fixing belt 21. Further, the fixing device 20 includes a nip forming member 24 and a stay 25 as a support member arranged inside the fixing belt 21, and a reflector member 26 for reflecting the light radiated from the halogen heater 23 to the fixing belt 21. The temperature of the fixing belt 21 is sensed by a temperature sensor 27 as a temperature sensing unit, and the temperature of the pressing roller 22 is sensed by a thermistor 29 as a temperature sensing unit. Furthermore, the fixing device 20 includes a detaching member 28 for detaching the sheet from the fixing belt 21, and a not-illustrated pressing unit for pressing the pressing roller 22 against the fixing belt 21.

The fixing belt 21 is made of a thin endless belt member (including a film) having plasticity. More specifically, the fixing belt 21 includes a base material for the inner circumference side formed of a material having a large thermal expansion such as nickel, SUS (Steel Use Stainless), or the like, and a mold releasing layer for the outer circumference side formed of tetrafluoroetylene-perfluoroalkylvinylether copolymer (PFA), polytetrafluoroethylene (PTFE), or the like. Further, an elastic layer formed of a rubber material such as a silicon rubber, a foam silicon rubber, a fluorine rubber, or the like may be interposed between the base material and the mold releasing layer.

The pressing roller 22 includes a core metal 22*a*, an elastic layer 22*b* provided on the surface of the core metal 22*a* and made of a foam silicon rubber, a silicon rubber, a fluorine rubber, and the like, and a mold releasing layer 22*c* made of the PFA, the PTFE, or the like and provided on the surface of the elastic layer 22*b*. The pressing roller 22 is pushed against the fixing belt 21 by the not-shown pressing unit and is in contact with the nip forming member 24. At the portion where the pressing roller 22 and the fixing belt 21 are pressed against each other, the elastic layer 22*b* of the pressing roller 22 is crushed, and thereby a nip portion N with a predetermined width is formed. Further, the pressing roller 22 is arranged so as to be rotation-driven by a motor M1 as a driving unit provided to the printer unit, as illustrated in FIG. 1. In response that the pressing roller 22 is rotation-driven, the driving force is transferred to the fixing belt 21 at the nip portion N and the fixing belt 21 rotates in response. It should be noted that the driving unit of the pressing roller 22 is separated from the driving unit of the pair of ejecting rollers 13, and thus the pair of ejecting rollers 13 are driven by a driving motor M2 that is a separate from that of the driving unit of the fixing unit (see FIG. 1). Further, as a way to separate the driving of the discharging unit, the driving of one motor may be divided by a clutch or the like to drive the respective motors independently.

Although the pressing roller 22 is a hollow roller in the present embodiment, a solid roller may be employed. Further, a heating source such as a halogen heater may be arranged inside the pressing roller 22. Without the elastic layer, the smaller heat capacity may allow for the improved fixity, but fine unevenness on the belt surface is likely to be transferred to the image and cause the gloss unevenness to occur in the mat portion of the image when the unfixed toner is crushed and fixed. In order to prevent this, it is desirable to provide the elastic layer having the thickness of 100 μm or more to the pressing roller 22. With the elastic layer having the thickness of 100 μm or more, the elastic deformation of the elastic layer allows for absorption of the fine unevenness, so that the gloss unevenness can be prevented. While the elastic layer 22*b* may be a solid rubber, a sponge rubber may be used when no heating source is inside the pressing roller 22. The sponge rubber is more preferable because it allows for higher thermal insulation, so that the heat of the fixing belt 21 is not likely to be dispersed. Further, the arrangement of the fixing member and the pressing member is not limited to the case where they are pressed against each other and may be simply in contact with each other without being pressed. Further, although not illustrated, the fixing device 20 has a pressing force varying mechanism for changing the pressing force for pressing the pressing roller 22 against the fixing belt 21.

Figure 10:
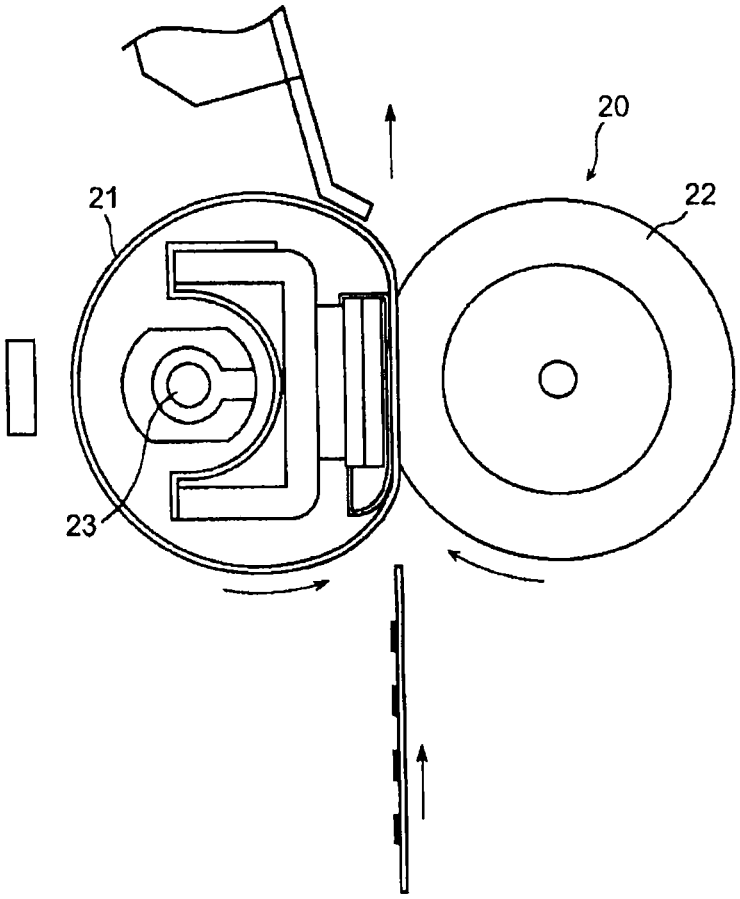
FIG. 10 is a view illustrating a cross section of a fixing device according to another embodiment installed in the image forming apparatus.
Figure 11:
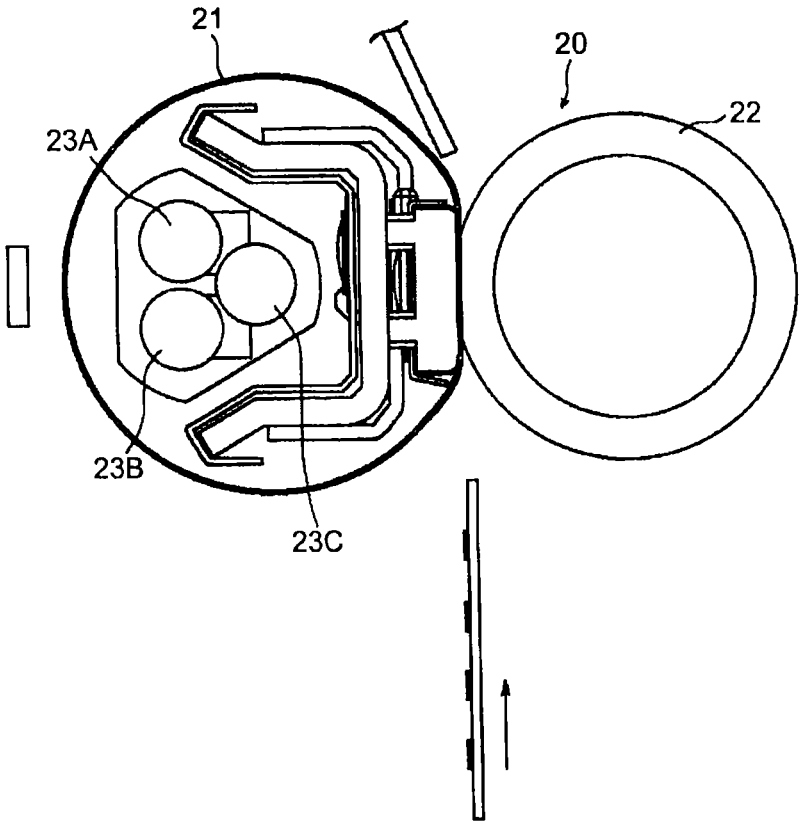
FIG. 11 is a view illustrating a cross section of a fixing device according to yet another embodiment installed in the image forming apparatus.

In the present embodiment, the halogen heater 23 includes two halogen heaters 23A (first halogen heater) and 23B (second halogen heater). Both ends of the respective halogen heaters 23A and 23B are fixed to a side plate (not illustrated) of the fixing device 20. Each of the halogen heaters 23A and 23B is configured so that the output is controlled to generate heat by a power supply unit provided to the printer unit, and the output control is performed based on the sensing result of the surface temperature of the fixing belt 21 by the temperature sensor 27. Such output control of the heaters 23A and 23B allows the temperature (fixing temperature) of the fixing belt 21 to be set to a desired value. It should be noted that the halogen heater 23 that is a heating source may be one heater for the entire area where the sheet can pass through, as illustrated in FIG. 10. Alternatively, the halogen heater 23 may be three heaters 23A, 23B, and 23C or more than three heaters that can heat different areas where sheet can pass through, respectively, as illustrated in FIG. 11. Further, the heating source for heating the fixing belt 21 may be a heat generating element other than the halogen heater, such as a ceramic heater or an IH heater.

The nip forming member 24 is arranged along a length in the axial direction of the fixing belt 21 or the axial direction of the pressing roller 22, and fixedly supported by a stay 25. This arrangement supports the pressure from the pressing roller 22 to prevent the nip forming member 24 from warping, so that an even width of the nip can be obtained along the axial direction of the pressing roller 22. In addition, it is desirable that the stay 25 be formed of the metal material such as stainless or iron having a high mechanical strength to be satisfactory for the function to prevent the warpage of the nip forming member 24. Furthermore, the stay 25 is formed to have a laterally long cross section extended in the pressing direction of the pressing roller 22, resulting in a larger section modules, which allows for the improved mechanical strength of the stay 25.

Further, the nip forming member 24 is made of a heat resisting member whose resistance temperature is equal to or more than 200° C. Accordingly, the deformation of the nip forming member 24 due to the heat is prevented in the range of the toner fixing temperatures, and the stable state of the nip portion N is ensured to stabilize the quality of the output image. For the nip forming member 24, general heat-resistant resin such as polyether sulphone (PES), polyphenylene sulfide (PPS), liquid crystal polymer (LCP), polyether nitrile (PEN), polyamide imide (PAI), polyether ether ketone (PEEK), and the like may be used. In the present embodiment, the LCP is used.

Further, the nip forming member 24 has a low friction sheet 240 on its surface. When the fixing belt 21 rotates, the fixing belt 21 slides on the low friction sheet 240, so that the driving torque generated at the fixing belt 21 is reduced. Thus, the load caused by the friction force to the fixing belt 21 is reduced.

A reflector member 26 is arranged between the stay 25 and the halogen heater 23. With the reflector member 26 arranged in this manner, the light radiated from the halogen heater 23 to the stay 25 is reflected to the fixing belt 21. Consequently, the light irradiated to the fixing belt 21 can be increased, which allows the fixing belt 21 to be efficiently heated. Further, the transfer of the radiation heat from the halogen heater 23 to the stay 25 can be suppressed, also allowing for energy saving.

Further, in the fixing device 20 according to the present embodiment, various ideas on configuration are implemented in order to further improve the energy saving property, a fast printing time, and the like.

Specifically, the fixing belt 21 can be directly heated at an area other than the nip portion N by the halogen heater 23 (direct heating system). In the present embodiment, nothing is interposed in the left area of the spaces between the halogen heater 23 and the fixing belt 21 when viewing FIG. 2 and, in that area, the radiation heat from the halogen heater 23 is directly provided to the fixing belt 21.

Further, in order to reduce the heat capacity of the fixing belt 21, the fixing belt 21 is formed thinner with a smaller diameter. Specifically, the respective widths of the base material, the elastic layer, and the mold releasing layer are set in the ranges of 20 to 100 μm, 100 to 300 and 5 to 50 μm so that the entire thickness is set to 0.45 mm or less. Further, the diameter of the fixing belt 21 is set to 20 to 40 mm. In order to further reduce the heat capacity, the entire thickness of the fixing belt 21 is desirably 0.3 mm or less, and more desirably 0.2 mm or less. Further, the diameter of the fixing belt 21 is desirably 30 mm or less. The fixing belt can be obtained by baking the elastic layer to the base material and coating it with the mold releasing layer.

It should be noted that, in the present embodiment, the diameter of the pressing roller 22 is set to 20 to 40 mm, and the diameter of the fixing belt 21 and that of the pressing roller 22 are the same. However, the arrangement is not limited to the above. For example, it may be formed such that the diameter of the fixing belt 21 is smaller than the diameter of the pressing roller 22. In this case, since the curvature of the fixing belt 21 is smaller than that of the pressing roller 22 in the nip portion N, the sheet P discharged from the nip portion N can be easily detached from the fixing belt 21.

As a result of the reduced diameter of the fixing belt 21, the space inside the fixing belt 21 is reduced. Therefore, in the present embodiment, the stay 25 is bent at its both ends to form a concave shape and the halogen heater 23 is accommodated inside the portion formed in the concave shape, which allows the stay 25 and the halogen heater 23 to be arranged even in a smaller space.

Further, in order to arrange a larger stay 25 even in the small space, the nip forming member 24 is, by contrast, formed more compact. Specifically, the width of the nip forming member 24 in the sheet conveying direction is formed smaller than the width of the stay 25 in the sheet conveying direction. Furthermore, in FIG. 2, h1 and h2 represent respective heights of an upstream end 24*a* and a downstream end 24*b* in the sheet conveying direction of the nip forming member 24 from the nip portion N (or its virtual extension line E). Then, assuming that h3 represents the maximum height of a portion of nip forming member 24 other than the upstream end 24*a* and the downstream end 24*b* from the nip portion N (or its virtual extension line E), it is configured to satisfy $h1 \leq h3$ and $h2 \leq h3$.

This arrangement results in that the upstream end 24*a* and the downstream end 24*b* of the nip forming member 24 are not interposed between each of the bent parts of the upstream side and the downstream side of the stay 25 in the sheet conveying direction and the fixing belt 21, so that each bent part can be arranged close to the inner circumference surface of the fixing belt 21. Therefore, the larger stay 25 can be arranged within the limited space inside the fixing belt 21, and thus the strength of the stay 25 can be ensured. As a result, the warping of the nip forming member 24 by the pressing roller 22 can be prevented, allowing for the improved fixity.

Described below is the fundamental operation of the fixing device according to the present embodiment. Once the power switch of the printer unit is turned on, the halogen heater 23 is supplied with power and the pressing roller 22 starts rotation-driving clockwise when viewing FIG. 2. Thereby, the friction force against the pressing roller 22 causes the fixing belt 21 to rotate anticlockwise in response, when viewing FIG. 2.

Then, the sheet P on which the unfixed toner image T is carried at the printing process as described above is conveyed in the direction of the arrow A1 in FIG. 2 while being guided by a guide plate 37, and is sent into the nip portion N that is in a state of being pressed. The toner image T is then fixed on the surface of the sheet P by the heat from the fixing belt 21 heated by the halogen heater 23 and the pressing force between the fixing belt 21 and the pressing roller 22.

The sheet P on which the toner image T has been fixed is conveyed out of the nip portion N to the direction of the arrow A2 in FIG. 2. At this step, in response to that the leading end of the sheet P comes into contact with the end of a detaching member 28, the sheet P is detached from the fixing belt 21. Then, the detached sheet P is discharged out of the apparatus by the pair of ejecting rollers 13 and stacked in the discharge tray 14 as described above.

Described below is the heating of the fixing belt 21 in the axial direction. As can be seen from FIG. 3, the first halogen heater 23A and the second halogen heater 23B have heat generating portion(s) in the positions different from each other. That is, the first halogen heater 23A has a heat generating portion (light emitting portion) 23A1 lying at the center portion in its longitudinal direction over a predetermined range. In the present embodiment, the heat generating portion 23A1 is provided in the range of 200 to 220 mm laterally symmetrically to the center in the longitudinal direction of the first halogen heater 23A. On the other hand, the second halogen heater 23B has heat generating portions (light emitting portions) 23B1 at its both ends in the longitudinal direction. In the present embodiment, the heat generating portions 23B1 are provided in the longitudinal direction so as to cover the outside areas of the area corresponding to the heat generating portion 23A1 of the first halogen heater 23A outward to the both ends of the belt width. Here, the sheet conveying width of a sheet of the A3 size and a sheet of the A4 size in the lateral direction is 297 mm and therefore the total length of the length of the heat generating portion 23A1 of the first halogen heater 23A and the length of the heat generating portions 23B1 of the second halogen heater 23B is set to 300 to 330 mm to have a longer width than the sheet conveying width as described above. Accordingly, the heat generated at the outer end areas of the heat generating portions 23B1 is smaller (the light emission intensity is weaker), causing a decrease in temperature. Thus, it is necessary to use the portion having a greater heat (heating intensity) than a predetermined value for the sheet conveying area.

Figure 3:
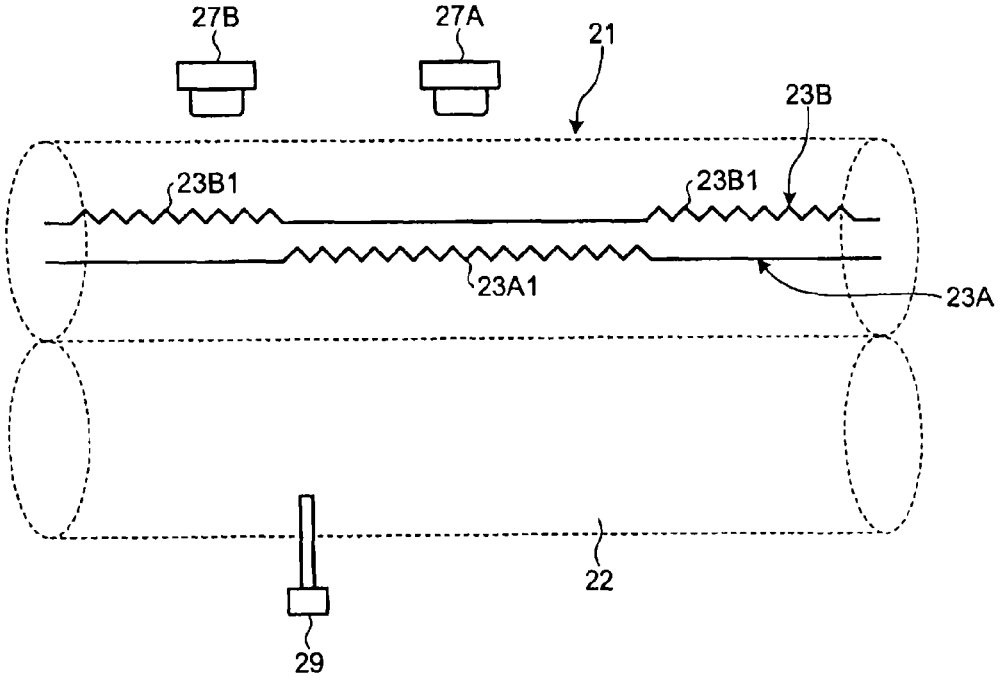
FIG. 3 is a view of the fixing device of FIG. 2 viewed in an axial direction.

In the present embodiment, two thermopiles are provided as the temperature sensor 27 for sensing the temperature of the fixing belt 21 as illustrated in FIGS. 2 and 3. A first thermopile 27A is set so as to sense the temperature of the middle area of the fixing belt 21 correspondingly to the heat generating portion 23A1 of the first halogen heater 23A. A second thermopile 27B is set so as to sense the temperature of the end area of the fixing belt 21 correspondingly to the heat generating portion 23B1 of the second halogen heater 23B.

As illustrated in FIG. 3, a thermistor (pressing thermistor) 29 for sensing the temperature of the pressing roller 22 is provided.

The halogen heater 23 is configured to have a heater and halogen sealed in a glass tube. Thus, after the heater is turned off, the heat accumulated in the glass tube will be still radiated. Therefore, when the halogen heater is used as a heating source, the fixing belt 21 will be temporarily heated by the remaining heat in the glass tube after the heater is turned off. Further, while the heat of the fixing belt is removed by the sheet P during sheet conveyance at the fixing nip N, no heat is released via the sheet P after the rear end of the sheet exits the fixing nip N (sheet conveyance is completed). Thus the temperature of the fixing belt may rise.

Figure 4:
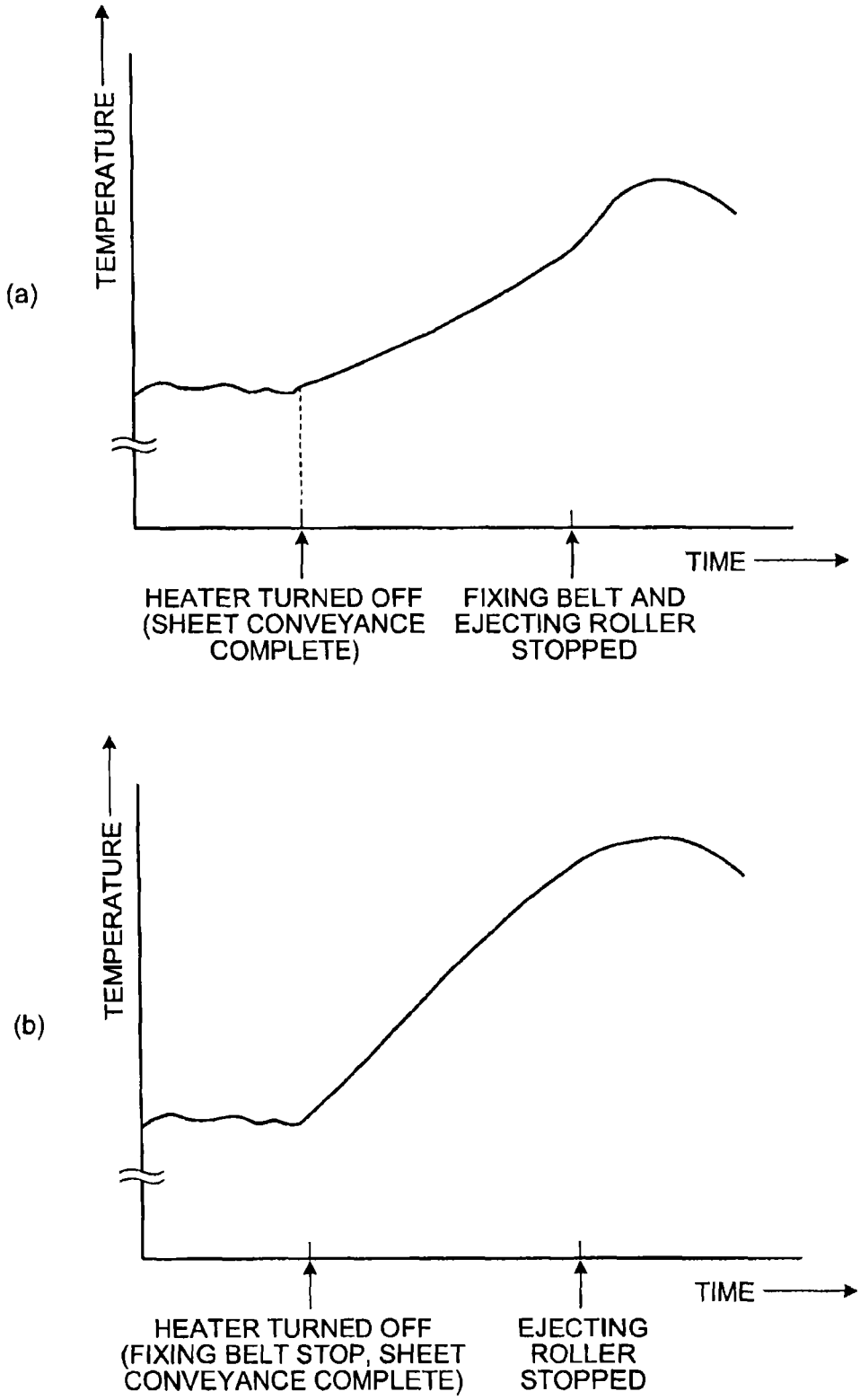
FIG. 4 illustrates changes in temperature of a fixing belt, in which a graph (a) shows the change in temperature when the fixing belt is rotated until a discharging roller stops after a heater is turned off and a graph (b) shows the change in temperature when the fixing belt stops at substantially the same timing as the turning off of the heater.

In FIG. 4, (a) illustrates the changes in temperature of the fixing belt when the fixing belt 21 is rotated until the pair of ejecting rollers 13 stops after the halogen heater 23 is turned off, and (b) illustrates the changes in temperature of the fixing belt when the rotation of the fixing belt 21 stops at substantially the same time as the turning off of the halogen heater 23. It should be noted that (a) and (b) of FIG. 4 illustrate, as an example, the case where the sheet conveyance is completed at the same time as the turning off of the halogen heater.

As such, the driving of the fixing device 20 stops before the driving of the discharging unit stops, which can facilitate the energy saving. In particular, the driving of the fixing device 20 has a greater torque than the driving of the discharging unit and the like, and therefore, stopping the driving as early as possible is a quite effective way for energy saving.

In the fixing device having the arrangement corresponding to (b) of FIG. 4, however, the rotation of the fixing belt 21 stops at the same time as the turning off of the heater. Therefore, the temperature of the fixing belt surges without heat release, and there is likelihood that the upper limit temperature is exceeded and the belt is broken depending on the heat accumulation state of the belt. On the other hand, in the fixing device having the arrangement corresponding to (a) of FIG. 4, since the heat of the fixing belt 21 is released by its rotation after the turning off of the heater, the rise in temperature of the fixing belt 21 is slow.

Figure 5:
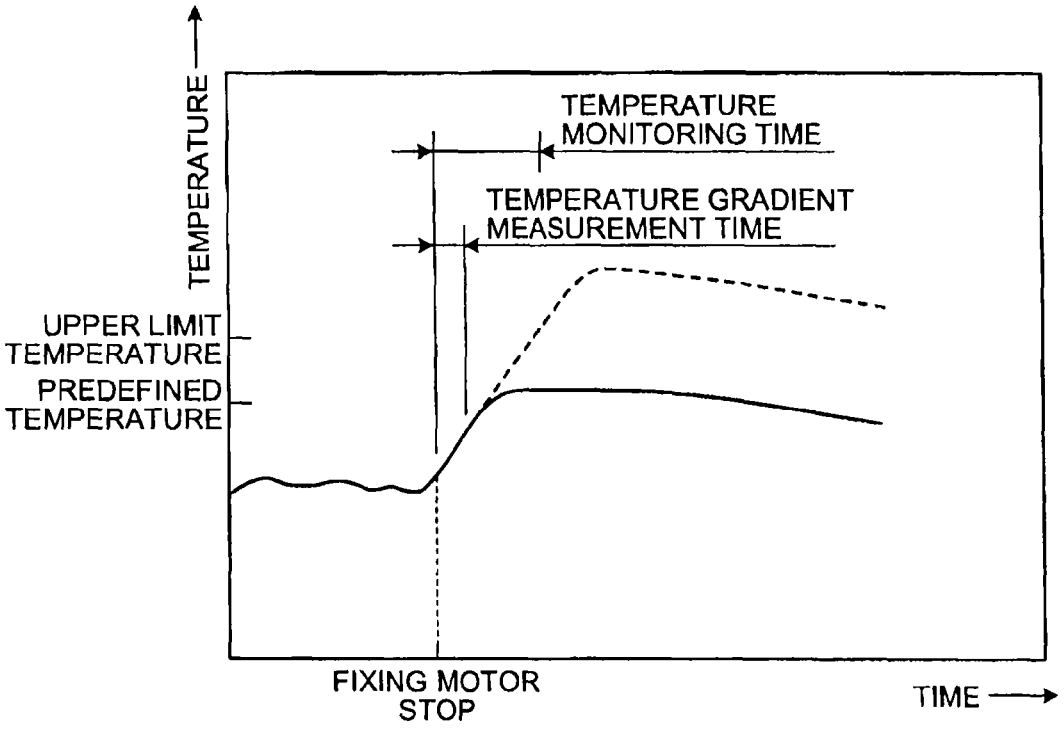
FIG. 5 is a graph illustrating changes in temperature of the fixing belt when the temperature of the fixing belt is monitored to rotate the belt as necessary after a fixing motor stops.

From the above finding, the fixing device of the present embodiment is configured such that the heat of the fixing belt 21 is released based on the detection value of the thermopile, which is the temperature sensor 27, after the fixing belt 21 stops rotating. The heat can be released, for example, by rotating the fixing belt 21 by the fixing motor M1. Specifically, as illustrated in FIG. 5, after the fixing motor M1 is stopped, the temperature of the fixing belt 21 is monitored for a predetermined time period. Then, at the time when the temperature conversion value D of the fixing belt 21 reaches or exceeds a predefined temperature that is less than the upper limit temperature, the fixing motor M1 is started up to rotate the fixing belt 21 for heat release. Accordingly, the overheat of the fixing belt 21 can be prevented as represented by the solid line in FIG. 5. It should be noted that the broken line in FIG. 5 represents the expected changes in temperature of the fixing belt 21 when the fixing belt 21 stops at the same time as the turning off of the heater and thereafter the stop state of the fixing belt 21 is maintained.

In the image forming apparatus such as the present printer and the like, the fixing device 20 is stopped when an abnormality occurs during the successive conveyance of the sheets. In such a situation, a problem of the kink, the belt breakage, or the like may occur in the fixing device 20 having the thin fixing belt 21 having a smaller heat capacity for the reduction of warm-up time and the reduction of consumption energy.

FIG. 6 illustrates the causes of abnormalities and the like for the stop of the rotation of the fixing belt 21 and the turning off of the heating source.

In FIG. 6, the cause of the abnormalities is categorized into: abnormalities of the fixing device 20, abnormalities of other devices than the fixing device 20, paper jam (occurring at the upstream side of the fixing device 20 in the conveying direction), paper jam (occurring at the downstream side of the fixing device 20 in the conveying direction), shortage of the tonner, a fully filled waste toner bottle, and end of life of the fixing device 20. The abnormalities of the fixing device 20, the abnormalities of devices other than the fixing device 20, and the end of life of the fixing device 20 are categorized into one of the states at the occurrence of the abnormalities, namely, during-sheet-conveyance, during-warm-up, and during-standby, while the paper jam (occurring at the upstream side of the fixing device 20 in the conveying direction), the paper jam (occurring at the downstream side of the fixing device 20 in the conveying direction), the shortage of the tonner, and the fully filled waste toner bottle are categorized into solely to the during-sheet-conveyance state.

As the abnormalities of the fixing device 20, detection of a high temperature or an abnormality of the temperature sensor is expected, and the fixing device 20 must be immediately stopped in any case because of the possibility of smoke emission or ignition. For the abnormalities of devices other than the fixing device and the end of life of the fixing device 20, the immediate step of the fixing device 20 is not necessary, it should be stopped after the sheet P on conveyance is discharged in the case of the during-sheet-conveyance, while it should be immediately stopped in the case of the during-warm-up and the during-standby. When the paper jam occurs in the upstream side of the fixing device 20 in the conveying direction, the fixing device 20 should be immediately stopped because no further sheet conveyance is allowed. When the paper jam occurs in the downstream side of the fixing device 20 in the conveying direction, the sheet P that has been conveyed to the fixing device 20 may be discharged. Also in the cases of the shortage of the toner and the fully filled waste toner bottle, since the immediate stop of the fixing device 20 is not necessary, it should be stopped after the sheet P during conveyance is discharged.

In the case that the fixing device 20 is immediately stopped because of the abnormality of the fixing device 20 during conveyance or the occurrence of the paper jam in the upstream side of the fixing device 20 in the conveying direction, it is expected that the sheet P on conveyance is caught in the nip portion of the fixing device 20. Therefore, continuous rotation of the fixing device may cause damage to other devices. Further, in case where the sheet P stops while winding around the fixing belt 21 or the pressing roller 22 without being detached therefrom, further rotation under the state may cause damage to the thermopile as the temperature sensor 27 or the thermistor 29. Therefore, when the immediate stop is made during sheet conveyance, the pressing roller 22 is reverse-rotated for one turn without depressurizing the pressing force. The reverse rotation of one turn or less of the fixing belt 21 does not cause the sheet P wound around the fixing belt 21 or the pressing roller 22 to do damage to the thermopile 27A, 27B, or the thermistor 29. Further, since the reverse rotation is one turn only and the conveying distance is about 100 mm, the rotation may not cause damage to the transfer device arranged in the upstream side in the conveying direction. The rotation speed for this action is desirably at a low level, such as a line speed of 50 to 80 mm/sec in order to increase the rotation time as much as possible.

Figure 7:
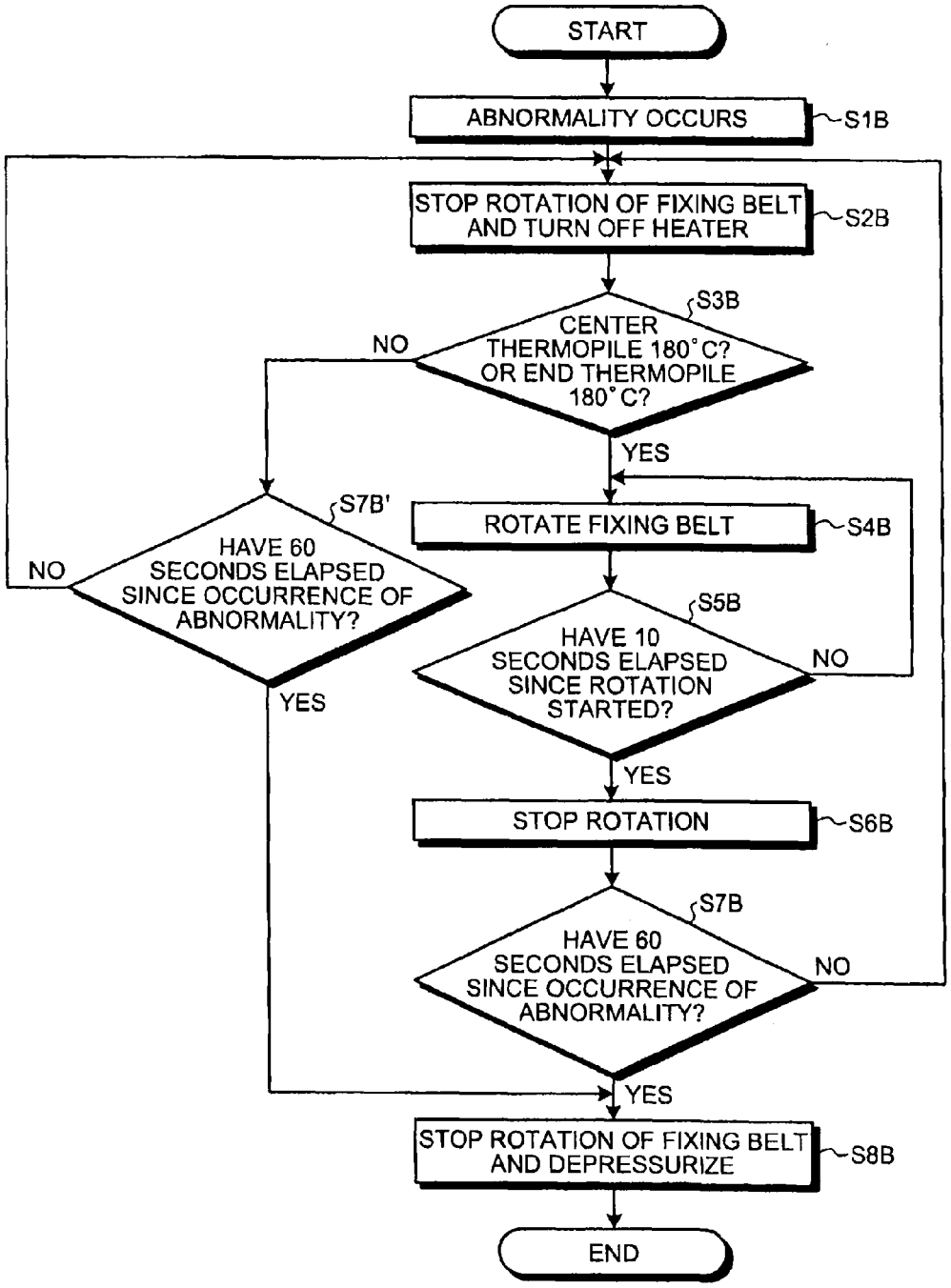
FIG. 7 is a flowchart illustrating a process at the time of the occurrence of an abnormality of the fixing device.

At the occurrence of abnormalities other than the case that requires to reverse-rotate the pressing roller 22 for one turn, the intermittent rotation as described later in detail is performed until the temperature drops to 180° C. or less. FIG. 7 is a flowchart illustrating the flow of the control for the intermittent rotation.

In FIG. 7, there may be an occurrence of the abnormality of the fixing device 20 except when it is during sheet conveyance, the abnormality of other device than the fixing device, the life of the fixing device, and the abnormalities of the paper jam in the downstream side of the fixing device 20 in the conveying direction, the shortage of the toner, and the fully filled waste toner bottle (step S1B). In response to the occurrence of these abnormalities, the rotation of the fixing belt is immediately stopped except when it is during sheet conveyance, while the motor M1 is turned off to stop the fixing belt after the sheet P on conveyance is discharged when it is during sheet conveyance, and then the heater is turned off (step S2B). Further, it is determined whether at least one of the sensed temperatures of the center thermopile 27A and the end thermopile 27B is 180° C. or more (step S3B). It should be noted that the reason for the threshold temperature being 180° C. is that, considering that the temperature during sheet conveyance is 140 to 160° C., the temperature of 180° C. or less is within the temperature deviation which does not deteriorate the fixing belt 21.

At step S3B as described above, if at least one of the sensed temperatures of the thermopiles 27A and 27B is 180° C. or more, the fixing belt 21 is rotated (step S4B) while the heater is still in the off state. Then, at step S5B, it is monitored whether the rotation continues for 10 seconds and, if the 10 seconds have elapsed, the rotation of the fixing belt 21 is stopped (step S6B). If the 10 seconds have not elapsed, the flow returns to step S4B.

Next, it is monitored whether 60 seconds have elapsed since the occurrence of the abnormality (step S7B). If the 60 seconds have elapsed, the rotation of the fixing belt 21 is stopped and the pressuring of the pressing roller 22 is depressurized (step S8B), and the flow ends. If it is not determined at step S7B that the 60 seconds have not elapsed, the flow returns to step S2B. It should be noted that, when the pressing force varying mechanism of the pressing roller 22 employs a cam (not illustrated) to perform the pressuring, the cam stops at the position where the weakest or no pressure is present. In the case where the pressuring is turned on and off by a solenoid and the like, the pressure is turned to an off state.

Further, all the sensed temperatures of the thermopiles 27A and 27B are lower than 180° C. at step S3B as described above, it is monitored whether 60 seconds have elapsed since the occurrence of the abnormality (step S7B'). If the 60 seconds have elapsed, the flow ends after the depressurizing at step S8B and, if it is not determined that the 60 second have not elapsed, the flow returns to step S2B.

Figure 8:
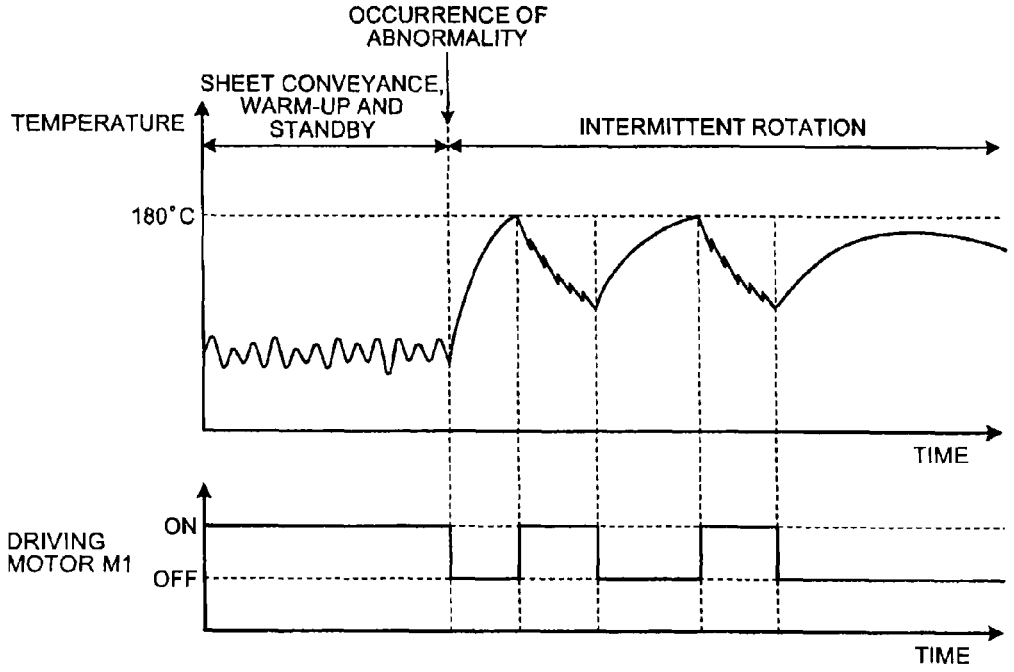
FIG. 8 is a view illustrating a temperature profile after the occurrence of an abnormality of the fixing device.

As such, in the cases of the abnormalities that do not require the immediate stop, the intermittent rotation according to the flow illustrated in FIG. 7 is performed. FIG. 8 is a view illustrating the operation of the driving motor M1 and the temperature profile during the intermittent rotation. As is clear from FIG. 8, when an abnormality occurs during sheet conveyance, during warm-up, or during print preparation, the power supply to the halogen heater 23 is stopped and the rotation of the driving motor M1 is also stopped. If the temperature of the center thermopile 27A exceeds 180° C. or if the temperature of the end thermopile 27B exceeds 180° C. after the stop, the driving motor is rotated for 10 seconds. At this step, no power is supplied to the halogen heater 23. After the 10 seconds have elapsed, if the temperature of the center thermopile 27A again exceeds 180° C. or if the temperature of the end thermopile 27B again exceeds 180° C., the driving motor is rotated for another 10 seconds. The above operation is repeated and, if the temperature at the time when the driving motor M1 stops is equal to or less than 180° C., the rotation is finished. Also, if 60 seconds have elapsed since the occurrence of the abnormality, the rotation is finished.

As such, when the temperature of the heater is high, the fixing belt 21 is rotated even after the stop due to the abnormality, so that the fixing belt 21 is not partially heated and thus the temperature deviation in the circumferential direction can be reduced. Thereby, the occurrence of the kink of the fixing belt 21, as described above, can be prevented. The pressing force varying mechanism maintains its pressing force that has been exhibited before the occurrence of the abnormality during the rotation of the fixing belt 21.

Figure 9:
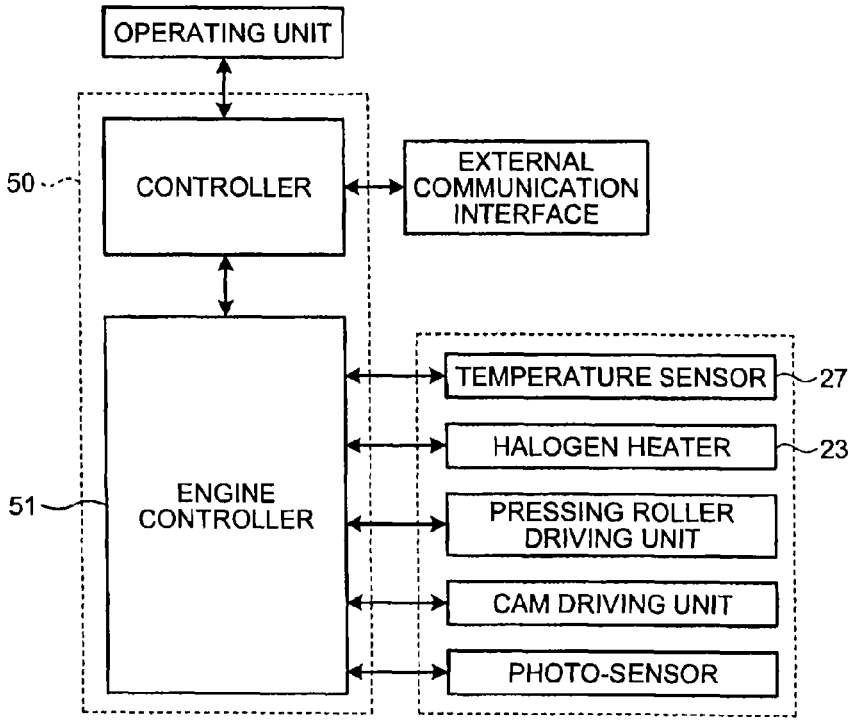
FIG. 9 is a block diagram illustrating an example of a control device which performs the control of FIG. 5.

In addition, FIG. 9 is a block diagram illustrating an example of a control device 50 for performing the above control. An engine controller 51 of the control device 50 controls the signaling with the halogen heater 23, the temperature sensors 27 including the center thermopile 27A and the end thermopile 27B, the driving motor M1 for driving the pressing roller, and so on.

With the intermittent rotation as the rotation of the fixing belt 21, the rotation is performed only for the timing necessary for obtaining its effect, which can prevent the failure of the fixing belt 21. In the case of the shortage of the tonner or the fully filled waste toner bottle, however, the cover may be opened for replacement and, therefore, the fixing device cannot be rotated in these cases. Therefore, instead of performing the intermittent rotation as described above, it may be configured to continue the rotation for a predetermined time to disperse the heat as quick as possible immediately after the occurrence of the abnormality before the cover is opened.

Further, in response to the opening of the cover, which is not limited to the time when the abnormality occurs, the image forming apparatus stops the operation of the machinery and thus the fixing device 20 is also stopped. In this state, since the main power supply is not turned off in the present invention, the driving of the fixing device is solely stopped after the intermittent rotation described above is performed.

It should be noted that, when the fixing belt 21 is rotated in response to the occurrence of the abnormality, the partial heating of the fixing belt 21 can be consistently prevented even through the fixing belt 21 is rotated for 60 seconds after the occurrence of the abnormality. In this case, unlike the intermittent rotation as described above, there may be a case where the rotation is performed for the time longer than is necessary. The rotation for the time longer than is necessary may cause degeneration in the durability of the member, and thus the rotation of the fixing belt 21 when the abnormality occurs is preferably the intermittent rotation.

Further, when the abnormality occurs, there is likelihood that the main power supply is turned off. The turning off of the main power supply may be refused for a predetermined time from the occurrence of the abnormality. Further, taking into consideration that the power supplied from the main power supply may be shut down, an auxiliary power source may be installed to supply the power at the time of the shut-down and start or continue the rotation of the fixing belt 21 as described above.

Although the embodiment has been described to be applied to the fixing device in which the support member is provided inside the plastic fixing belt as the fixing member, it may be applied to the fixing device in which the fixing member includes the fixing belt provided in a hanging manner between the fixing roller and the heating roller.

According to the embodiments, when an abnormality occurs inside the image forming apparatus, the operation during the image forming, including the turning off of the heating source of the fixing device, is stopped and the rotation of the fixing member is controlled after the stop. Accordingly, the fixing member is not partially heated, which can reduce the local increase of the temperature. Therefore, the present invention can prevent the occurrence of the problems such as the breakage of the fixing member at the stop due to the abnormal state.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a fixing device including a rotatable endless fixing member, a nip forming member arranged inside the fixing member, a pressing member in contact with the nip forming member via the fixing member, and a heating source configured to heat the fixing member, wherein the heating source heats the fixing member using radiant heat, and when an abnormality occurs in at least one of the fixing device and other devices included in the image forming apparatus, a rotation of the fixing member is stopped and, after stopping the fixing member and before the abnormality is solved, the fixing member is controlled to rotate intermittently.

2. An image forming apparatus comprising:

a fixing device including a rotatable endless fixing member, a nip forming member arranged inside the fixing member, a pressing member in contact with the nip forming member via the fixing member, and a heating source configured to heat the fixing member, wherein the heating source heats the fixing member using radiant heat, when an abnormality occurs in at least one of the fixing device and other devices included in the image forming apparatus, a rotation of the fixing member is stopped and, after stopping the fixing member, the fixing member s controlled to rotate, and when the abnormality of the image forming apparatus occurs during sheet conveyance and rotation of the fixing member is stopped before a recording medium that has been on conveyance in the fixing device at a time of occurrence of the abnormality is discharged, a reverse driving of the fixing device for one turn or less is performed.

3. An image forming apparatus comprising:

a fixing device including a rotatable endless fixing member, a nip forming member arranged inside the fixing member, a pressing member in contact with the nip forming member via the fixing member, and a heating source configured to heat the fixing member, wherein the heating source heats the fixing member using radiant heat, when an abnormality occurs in at least one of the fixing device and other devices included in the image forming apparatus, a rotation of the fixing member is stopped, the fixing member is rotated in a state where a pressing force is applied between the pressing member and the fixing member after stopping the rotation of the fixing member and before the abnormality is solved, and a pressure between the pressing member and the fixing member from the pressing force is depressurized after the rotation of the fixing member is stopped.

4. The image forming apparatus according to claim 3, wherein the fixing member is controlled to rotate intermittently.

5. The image forming apparatus according to claim 3, wherein the rotation of the fixing member continues for 10 seconds when the fixing member is rotated.

6. The image forming apparatus according to claim 5, wherein the fixing member is controlled to rotate intermittently.

7. The image forming apparatus according to claim 3, wherein the pressing member includes a foam silicone rubber.

8. The image forming apparatus according to claim 3, wherein the fixing member includes nickel.

9. The image forming apparatus according to claim 3, wherein the fixing member includes a diameter of 20 mm to 40 mm.

10. The image forming apparatus according to claim 3, wherein the fixing member includes a thickness of 0.3 mm or less.

11. The image forming apparatus according to claim 3, wherein rotation of the fixing member after the stopping is in a reverse direction of the rotation of the fixing member before the stopping.

12. The image forming apparatus according to claim 3, wherein the fixing member is rotated when a temperature of the fixing member equal to or more than a predetermined temperature.

13. The image forming apparatus according to claim 3, wherein the fixing member is directly heated at an area other than a nip portion by the heating source.

14. The image forming apparatus according to claim 3, further comprising a mechanism to change the pressing force between the pressing member and the fixing member.

15. The image forming apparatus according to claim 3, further comprising a support member configured to support the nip forming member, the support member being arranged inside the fixing member.

16. The image forming apparatus according to claim 15, further comprising a reflector member arranged between the support member and the heating source.

17. The image forming apparatus according to claim 3, further comprising a rotatable ejecting member configured to discharge a sheet, wherein rotation of the ejecting member is driven separately from rotation of the fixing member.

18. The image forming apparatus according to claim 17, wherein one motor drives the ejecting member and the fixing member using a clutch to separate driving of the ejecting member from driving of the fixing member.

19. The image forming apparatus according to claim 3, wherein rotation of the fixing member is performed only in a predefined time from occurrence of the abnormality.

20. The image forming apparatus according to claim 3, wherein when a temperature of the fixing member is equal to or more than a predetermined temperature, rotation of the fixing member is stopped, and when the temperature of the fixing member is still equal to or more than a predetermined temperature after the rotation of the fixing member is stopped, the fixing member is rotated for a predetermined time intermittently.

21. The image forming apparatus according to claim 20, wherein the intermittent rotation is performed only when the abnormality of the image forming apparatus occurs during sheet conveyance and the rotation is stopped after a recording medium that has been on conveyance in the fixing device at a time of occurrence of the abnormality is discharged, or when the abnormality occurs during warm-up or during standby.

22. The image forming apparatus according, to claim 3, wherein when the abnormality of the image forming apparatus occurs during sheet conveyance and rotation of the fixing member is stopped before a recording medium that has been on conveyance in the fixing device at a time of occurrence of the abnormality is discharged, a reverse driving of the fixing device for one turn or less is performed.

23. The image forming apparatus according to claim 3 further comprising a pressing force varying mechanism configured to change the pressing force between the fixing member and the pressing member, wherein during rotation of the fixing member after the abnormality of the image forming apparatus occurs, a pressing force that has been exhibited before occurrence of the abnormality is maintained.

24. The image forming apparatus according to claim 3, wherein, during rotation of the fixing member after the abnormality of the image forming apparatus occurs, the rotation of the fixing member is performed even after a cover of the image forming apparatus is opened.

25. The image forming apparatus according to claim 3 further comprising an auxiliary power supply device, wherein when power supplied from a power supply is shut down during rotation of the fixing member after the abnormality of the image forming apparatus occurs, the rotation of the fixing member is continued due to power supplied from the auxiliary power supply device.

26. The image forming apparatus according to claim 23, wherein the stopping of the rotation of the fixing member includes turning off the heating source.

27. A method of operating an image forming apparatus that includes a fixing device including a rotatable endless fixing member, a nip forming member arranged inside the fixing member, a pressing member in contact with the nip forming member via the fixing member, and a heating source configured to heat the fixing member, the method comprising:

heating the fixing member with the heating source using radiant heat;

stopping a rotation of the fixing member when an abnormality occurs in at least one of the fixing device and other devices included in the image forming apparatus;

after the stopping and before the abnormality is solved, rotating the fixing member in a state where a pressing force is applied between the pressing member and the fixing member; and depressurizing a pressure between the pressing member and the fixing member from the pressing force after the rotation of the fixing member is stopped.

* * * * *